US008043201B2

(12) United States Patent
Baumann

(10) Patent No.: US 8,043,201 B2
(45) Date of Patent: Oct. 25, 2011

(54) CENTRIFUGES FOR A LUBRICANT OIL IN AN INTERNAL COMBUSTION ENGINE WITH A MODULAR HOUSING SYSTEM HAVING VARIOUS BASES, LIDS AND ROTORS

(75) Inventor: Dieter Baumann, Greven (DE)

(73) Assignee: Hengst GmbH & Co. KG, Muenster (DE)

( * ) Notice: Subject to any disclaimer, the term of this patent is extended or adjusted under 35 U.S.C. 154(b) by 898 days.

(21) Appl. No.: 12/065,936

(22) PCT Filed: Aug. 23, 2006

(86) PCT No.: PCT/EP2006/008257

§ 371 (c)(1),
(2), (4) Date: Mar. 6, 2008

(87) PCT Pub. No.: WO2007/028498

PCT Pub. Date: Mar. 15, 2007

(65) Prior Publication Data

US 2009/0215603 A1 Aug. 27, 2009

(30) Foreign Application Priority Data

Sep. 8, 2005 (DE) ..... 20 2005 014 232 U

(51) Int. Cl.
*B04B 5/10* (2006.01)
*B04B 9/06* (2006.01)

(52) U.S. Cl. ..... 494/31; 494/49; 494/60

(58) Field of Classification Search ..... 494/24, 494/36, 43, 49, 64, 65, 67, 83, 84, 901, 5, 494/60, 31–34; 210/171, 232, 360.1, 380.1, 416.5; 184/6.24
See application file for complete search history.

(56) References Cited

U.S. PATENT DOCUMENTS

| | | | | |
|---|---|---|---|---|
| 4,284,504 | A | 8/1981 | Alexander et al. | |
| 4,288,030 | A * | 9/1981 | Beazley et al. | 494/49 |
| 4,400,167 | A * | 8/1983 | Beazley et al. | 494/49 |
| 4,492,631 | A * | 1/1985 | Martin | 210/127 |
| 4,498,898 | A * | 2/1985 | Haggett | 494/49 |
| 4,557,831 | A * | 12/1985 | Lindsay et al. | 210/232 |
| 5,096,581 | A * | 3/1992 | Purvey | 210/232 |
| 6,234,949 | B1 * | 5/2001 | Cox et al. | 494/49 |
| 6,533,712 | B1 * | 3/2003 | Miller et al. | 494/60 |
| 6,702,729 | B2 * | 3/2004 | Mazzuca | 494/26 |
| 6,929,596 | B2 * | 8/2005 | Amirkhanian et al. | 494/49 |
| RE38,855 | E * | 10/2005 | Cox et al. | 494/49 |

(Continued)

FOREIGN PATENT DOCUMENTS

DE 101 48 839 5/2002

(Continued)

*Primary Examiner* — Charles E Cooley
(74) *Attorney, Agent, or Firm* — Greer, Burns & Crain, Ltd.

(57) ABSTRACT

Centrifuges, in particular for a lubricant oil in an internal combustion engine, are provided with a housing which comprises a base, a lid forming the second part of the housing and connectable to the base and a rotor arrangeable in the housing. Each centrifuge is embodied in the form of a modular unit which is assembled with the aid of modular system parts, wherein the modular system comprises different bases, and/or different lids and/or different rotors which can be assembled in the form of different combinations in such a way that different centrifuges are obtained.

19 Claims, 10 Drawing Sheets

U.S. PATENT DOCUMENTS

| | | | | |
|---|---|---|---|---|
| 6,984,200 | B2 * | 1/2006 | Samways | 494/49 |
| 7,235,177 | B2 * | 6/2007 | Herman et al. | 210/360.1 |
| 7,377,893 | B2 * | 5/2008 | Herman et al. | 494/49 |
| 7,393,317 | B2 * | 7/2008 | Herman | 494/49 |
| 7,407,474 | B2 * | 8/2008 | Smith | 494/49 |
| 7,597,658 | B2 * | 10/2009 | Samways et al. | 494/49 |
| 2002/0042334 | A1 | 4/2002 | Tetsu et al. | |
| 2005/0187091 | A1 | 8/2005 | South | |
| 2006/0003882 | A1 * | 1/2006 | Smith | 494/49 |
| 2006/0240965 | A1 * | 10/2006 | Herman et al. | 494/49 |
| 2006/0258523 | A1 * | 11/2006 | Samways et al. | 494/49 |
| 2009/0215603 | A1 * | 8/2009 | Baumann | 494/17 |

FOREIGN PATENT DOCUMENTS

| | | | |
|---|---|---|---|
| GB | 2465374 | A * | 5/2010 |
| WO | WO 03/047759 | | 6/2003 |

* cited by examiner

CENTRIFUGES FOR A LUBRICANT OIL IN AN INTERNAL COMBUSTION ENGINE WITH A MODULAR HOUSING SYSTEM HAVING VARIOUS BASES, LIDS AND ROTORS

BACKGROUND OF THE INVENTION

The present invention relates to centrifuges, in particular for the lubricant oil of an internal combustion engine, having a housing that comprises a base that forms a first housing part and a lid that is connectable to the base and that forms a second housing part, and having a rotor situated in the housing.

Centrifuges of the type named above have long been used and are generally known due to their wide distribution, including use for the lubricant oil of an internal combustion engine. In this use, centrifuges are used to separate out fine particles of dirt that are carried along in the lubricant oil of the internal combustion engine. Here it is standard for the centrifuge to be situated in a bypass flow of the lubricant oil circuit of the internal combustion engine, while in the main flow of the lubricant oil circuit a lubricant oil filter having an exchangeable filter insert is standardly present. In internal combustion engines, in particular large engines such as those used in ships or locomotives, or for large stationary drives, it is known to arrange two lubricant oil filters in parallel, each of which can be individually separated from the lubricant oil circuit. This creates the possibility of performing maintenance on the oil filter separated from the lubricant oil circuit, in particular exchanging a filter insert situated therein, without having to interrupt the overall circulation of lubricant oil. In this way, continuous operation of the associated internal combustion engine can be ensured. The double arrangement of a centrifuge is not required in this context, and is also not known, because the centrifuge is situated in the bypass flow, which can be temporarily shut off as needed without any disadvantage for the circulation of the lubricant oil, i.e. for maintenance of the centrifuge.

In many internal combustion engines, in particular the above-mentioned large engines for driving ships or locomotives, or in large stationary internal combustion engines, very large rotors, corresponding to the large quantity of circulating lubricant oil, are used in the centrifuge; in practice, these rotors can have a volume of up to six or seven liters, as a function of the size of the associated internal combustion engine. Due to its size, such a rotor has to be made of metal, which means that the rotor is relatively heavy. Moreover, due to the size and weight of the rotor containing the lubricant oil and deposited dirt, the bearing of the rotor is expensive. Due to its size and its correspondingly high mass, despite the use of a large amount of lubricant oil for its drive the rotor nonetheless achieves only relatively low rotational speeds, which is harmful from the point of view of the deposition of dirt. Moreover, another disadvantage is that in order to match differently sized internal combustion engines, many different centrifuges have to be manufactured and kept in reserve, which makes the manufacturing, storage, and marketing of the centrifuges, and stocking replacement parts for them, difficult and expensive.

Therefore, the problem addressed by the present invention is to create centrifuges of the type named above that avoid the stated disadvantages and in which in particular a more economical and simpler manufacturing can be achieved with a variable adaptability to different requirements, easier warehousing and supplying of replacement parts, and more economical and more effective operation.

SUMMARY OF THE INVENTION

According to the present invention, this problem is solved by centrifuges of the type named above that are characterized in that each centrifuge is a modular unit assembled from parts of a modular system, the modular system comprising different bases and/or different lids and/or different rotors that can be assembled in different combinations to form different centrifuges.

The modular centrifuges according to the present invention advantageously enable a simpler and in particular significantly more economical manufacturing of different centrifuges, it being possible to combine and assemble different parts of the modular system with one another in different combinations in order to form different centrifuges. Stocking and supplying of replacement parts is also made simpler, and thus more economical, in this way. The different rotors advantageously have volumes that differ by suitable steps, in order to enable the performance level of the centrifuge to be adapted to differently sized internal combustion engines. In this way, a spectrum of centrifuge sizes and performance levels that is sufficient for practical use can be covered with a relatively small number of different sizes of rotors.

A first embodiment of the present invention provides that the modular system comprises a unified or common base, lids having different heights, and rotors having different heights. In this embodiment of the present invention, the base remains the same, while only lids of different heights and rotors of different heights are used to achieve different performance levels of the centrifuge. This makes in particular the manufacture of the base, which is the most expensive component, particularly economical, because a unified base can be used for centrifuges of different sizes. In this way, the base can be manufactured in larger piece counts, which reduces the manufacturing cost per piece.

Another embodiment of the present invention provides that the modular system comprises different bases that differ from one another in the height of a peripheral wall that works together with the lid, a unified lid or lids having different heights, and rotors having different heights. In this embodiment, in addition the differing height of the peripheral wall is used to produce centrifuges having different sizes. Here, the base preferably remains unchanged in all parts other than its peripheral wall, which means that while different bases must be manufactured, these differ only in the height of their peripheral wall. This still enables economical manufacturing, because for example if the base is manufactured by casting, large parts of a casting mold can be used for different bases; for different peripheral wall heights, e.g. exchangeable casting mold parts can be used in the casting mold.

The present invention also provides the possibility that the modular system comprises different bases that differ in the number of rotors that are connectable thereto. In this embodiment of the present invention, a base can bear two, three, or more rotors, the rotors being available from the modular system. Here, the rotors can be identical to one another or may also be different from one another, enabling here as well a good adaptation of the centrifuge to differing requirements.

In another embodiment, it is proposed that a number of lids corresponding to the number of rotors be connectable to the different bases, the lids being uniform or having different heights, and each lid being allocated to one of the rotors. That is, in this embodiment each rotor is allocated a separate lid. Here, each lid can be adapted in its height to the associated rotor, and of course here as well the possibility again exists of connecting rotors that are identical to each other and identical lids, or, alternatively, rotors having different heights and lids adapted thereto, having different heights, to the common base.

In an alternative development, it is proposed that a lid be connectable to each of the different bases that is common to all rotors and is adapted to the number and to the height of the rotors and to a spatial arrangement of the rotors. Thus, in this embodiment only a single lid is required that is common to all the rotors, facilitating manufacture and installation as well as maintenance of the centrifuge, and enabling a savings in weight to be realized.

According to another embodiment of the present invention, it is possible for the modular system to comprise different bases, namely a first base that is connectable as a master base to an associated device, in particular an internal combustion engine, and at least one second base that, as a slave base, is connectable to the first base. This embodiment of the present invention advantageously offers the possibility of manufacturing a centrifuge as needed having one or more rotors, a separate base being allocated to each rotor. In a minimal configuration, the centrifuge consists of the master base with one associated rotor and lid. As needed, i.e. when a higher centrifuge performance level is required, one or more slave bases can be connected to the master base, each slave base in turn bearing a rotor and a lid. Of course, as already explained above, if two or more bases are used the rotors or lids can be identical to one another or different from one another.

Another embodiment of the present invention provides that the modular system comprises a base that is connectable on the one hand to an associated device, in particular an internal combustion engine, and is connectable on the other hand to additional, identical bases in series connection. Thus, here advantageously only a single embodiment of the base is required, this embodiment of the base being characterized in that a connection in series of identical bases is possible. In this way, based on a centrifuge having a base and having a rotor and a lid, a centrifuge having two or more bases and a corresponding number of rotors and lids can be assembled in modular fashion in order to match the centrifuge to the needs of the particular situation. If the centrifuge comprises a plurality of bases, it is of course here also possible to select the rotors and lids to be identical to one another or different from one another.

Many internal combustion engines, in particular especially large engines, are often manufactured in relatively small piece counts, which has the consequence that only a correspondingly small number of centrifuges are required for them. For this case in particular, the present invention provides that the base is a component that is manufactured individually so as to be adapted to an associated device, in particular an internal combustion engine, and that can be assembled with different lids and/or with different rotors in various combinations to form different centrifuges. For example, here the base can be a sand casting that can be economically manufactured even in relatively small piece counts. Rotors and lids from the modular program can then be connected to this individually manufactured base, so that expensive special productions are not necessary for the rotors and lids.

In order in particular to achieve a simple installation of the centrifuges according to the present invention, it is preferably provided that the/each base have one or more connecting flanges that create a simultaneous mechanical and flow connection, for connection to an associated device, in particular an internal combustion engine, and/or for connection to another base. This ensures a simple and problem-free installation of the centrifuges, in which external conduits, which are expensive to attach and are liable to damage, are not required.

Finally, for the centrifuges according to the present invention it is also preferably provided that each centrifuge is a free jet centrifuge, the/each rotor having at least one jet nozzle. In this way, the base, the lid, and an axle that bears the rotor advantageously remain completely free of drive parts for the drive of the rotor, which keeps the named parts constructively simple and economical to manufacture.

Because within the modular system the individual rotors can be smaller, it is advantageously possible for the/each rotor to be made mostly or completely of plastic. This enables an economical manufacturing, provides an advantageous low weight of the rotors, and provides for high rotational speeds of the rotors during operation, which is very advantageous from the point of view of the deposition of dirt.

In addition, a plurality of small rotors advantageously require for their drive a lower quantity of fluid than does a large rotor having a volume corresponding to the sum of the volumes of the small rotors, contributing to improved efficiency.

In practice, it can for example be provided that the various rotors of the modular system have a volume of 0.8 liters, 1.0 liters, 1.2 liters, and 1.8 liters. This permits a volume range to be covered of between 0.8 liters as a minimum, if only the smallest rotor is used, and several liters, given the use of a plurality of the large, or the largest, rotors in the centrifuge. A fine gradation in steps down to 0.2 liters is possible.

BRIEF DESCRIPTION OF THE DRAWINGS

In the following, exemplary embodiments of the present invention are explained on the basis of a drawing.

BRIEF DESCRIPTION OF THE DRAWINGS

Figure 1:
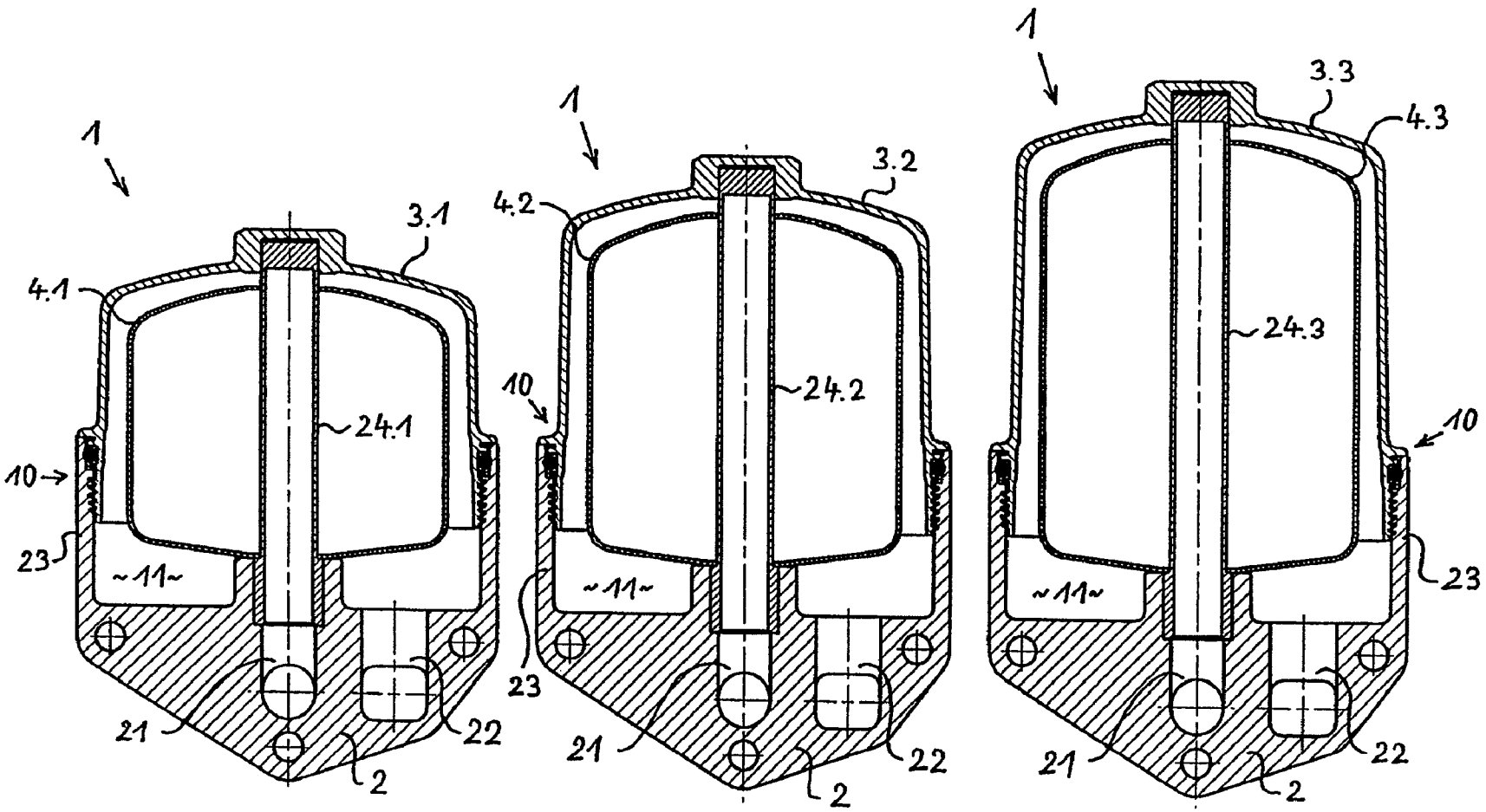
FIG. 1 shows three different centrifuges alongside one another having identical bases, in longitudinal section.

FIG. 1 shows three different centrifuges 1 alongside one another, for which it is characteristic that they have identical bases 2 each of which forms a lower housing part. Each base 2 comprises a supply channel 21 for a fluid that is to be cleaned in centrifuge 1, for example the lubricant oil of an associated internal combustion engine, as well as a drainage channel for carrying off the cleaned liquid from centrifuge 1. In addition, each base 2 comprises a peripheral wall 23 that extends upward. In each of the three centrifuges 1 shown in FIG. 1, a lid 3.1, 3.2, 3.3 is connected to peripheral wall 23; here, the lids are removably screwed on, with intermediate situation of a sealing ring. Lids 3.1 to 3.3 each have at the bottom an identical connecting end for connection to peripheral wall 23, but have heights that are different from one another, as is shown in FIG. 1.

In interior space 11 of each housing 10 formed by base 2 and the associated lid 3.1, 3.2, or 3.3, there is situated an axle 24.1 or 24.2 or 24.3, which is here set fixedly in associated base 2. Corresponding to the different heights of lids 3.1 to 3.3, axles 24.1 to 24.3 have differing axial lengths adapted thereto.

Finally, in the interior 11 of each centrifuge 1 there is situated a rotor 4.1 or 4.2 or 4.3. Rotor 4.1 of centrifuge 1 at the left in FIG. 1 has a height, here relatively low, that is adapted to the height of lid 3.1 and to the length of axle 24.1. Rotor 4.2 of second centrifuge 1 in FIG. 1 has a greater height, and rotor 4.3 of centrifuge 1 at right in FIG. 1 has, finally, the greatest height.

The example shown in FIG. 1 illustrates that with an identical base 2 a plurality (here three) centrifuges 1 having different sizes can be produced, each having a rotor 4.1 to 4.3 having different volumes, and thus having different performance levels. The base, as a relatively expensive component, is identical in all three centrifuges 1 shown in FIG. 1, so that base 2 can be manufactured in a correspondingly higher piece count, which reduces the manufacturing costs per piece. Differing from one another are axles 24.1 to 24.3, lids 3.1 to 3.3, and rotors 4.1 to 4.3; these components each have a simpler construction compared to base 2, and can thus also be manufactured in different sizes, here different heights, at relatively low expense. In this way, a first variable and economical modular system for a modular manufacture of centrifuges 1 in different sizes and performance levels is enabled.

Figure 2:
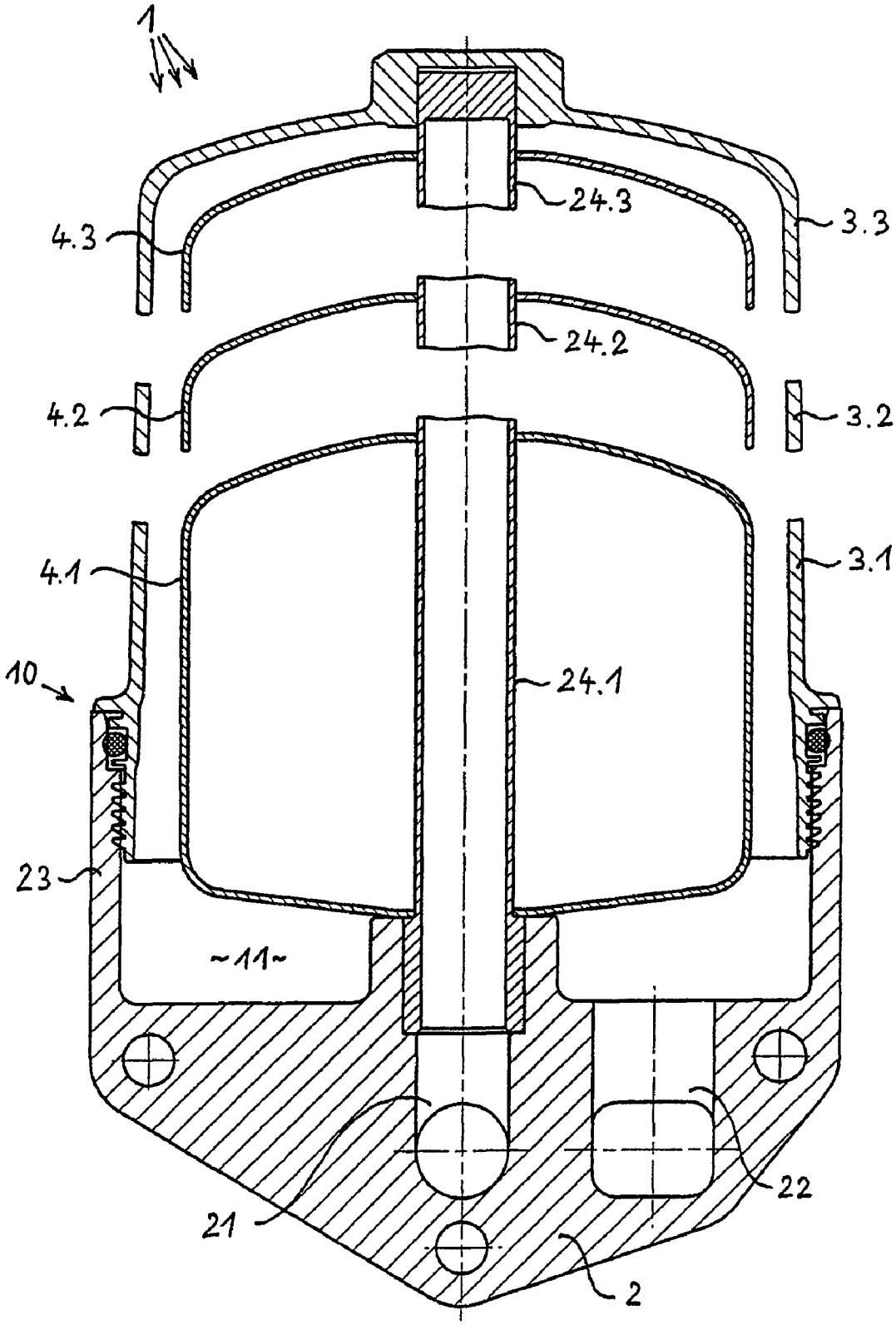
FIG. 2 shows the three centrifuges of FIG. 1, now shown one after the other, also in longitudinal section.

FIG. 2 shows the three centrifuges 1 from FIG. 1, now shown in an arrangement one after the other, making clear the different heights and the otherwise present agreement. At the bottom of FIG. 2, base 2, which is unified for all three centrifuges 1, can be seen, here again in longitudinal section. Supply channel 21 and drainage channel 22 are situated in base 2. The three lids having different heights, 3.1 to 3.3, are connectable to unified base 2, and together with peripheral wall 23 and the lower part of base 2 these lids form housings 10 of centrifuges 1. The differently high lids 3.1 to 3.3 result in differently high realizations of the interior space 11 of housing 10, so that axles 24.1 to 24.3 having correspondingly different lengths and rotors 4.1 to 4.3 having correspondingly different heights can be housed therein.

FIG. 3 shows, again in longitudinal section, an embodiment of centrifuge 1 in which base 2 is modified in comparison with FIGS. 1 and 2. The change in base 2 here is that now peripheral wall 23 is higher, while in other respects base 2 agrees with the embodiment of base 2 shown in FIG. 1 and FIG. 2.

Figure 3:
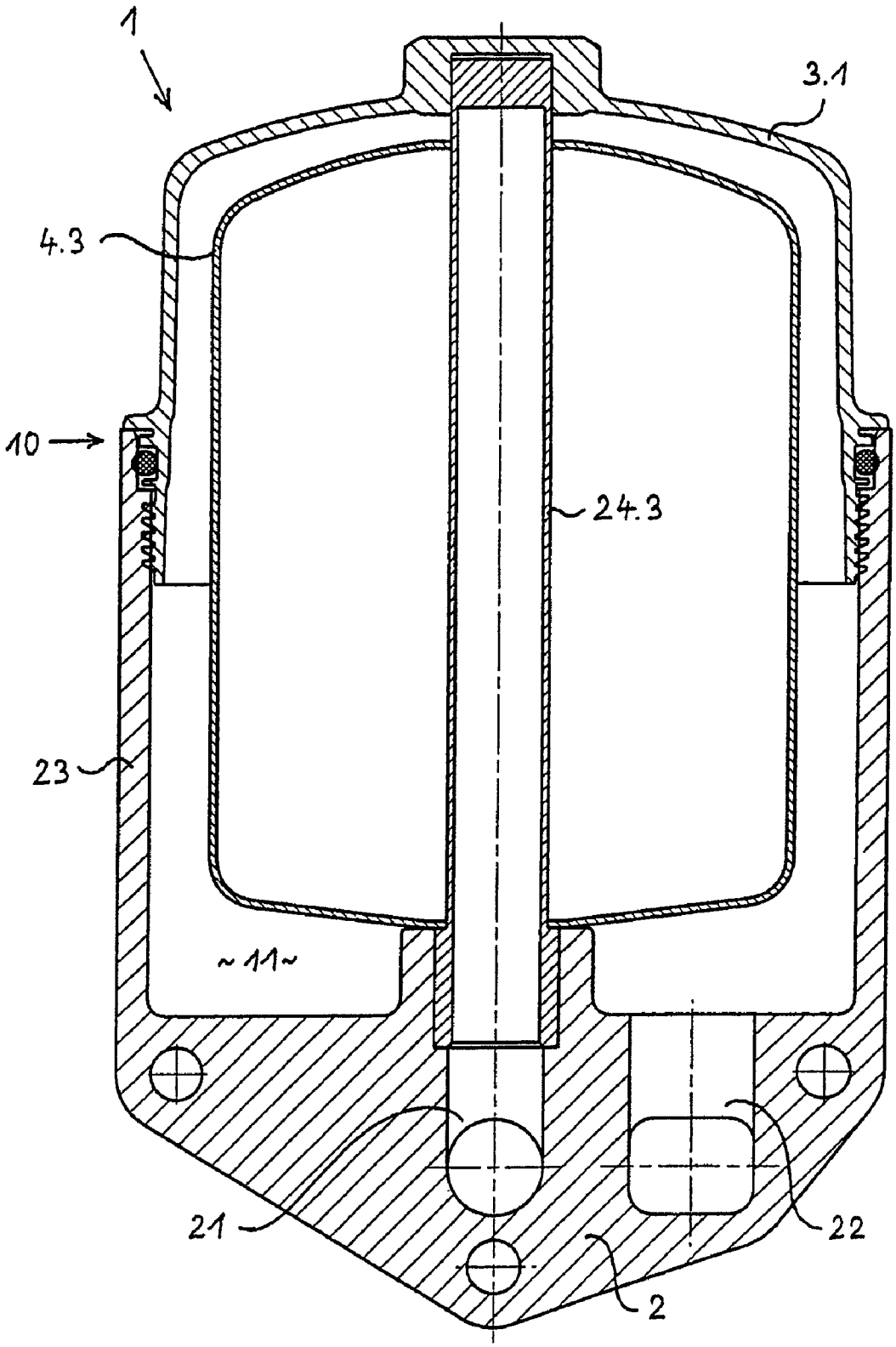
FIG. 3 shows another embodiment of the centrifuges in longitudinal section.

The greater height of peripheral wall 23 achieves a correspondingly greater height of interior 11 of housing 10 of centrifuge 1. Further variation in the height of interior 11 of housing 10 is enabled in that lids 3.1 to 3.3 having different heights are connected to base 2. In the example shown in FIG. 3, lid 3.1 having the smallest height according to FIG. 1 and FIG. 2 is connected to peripheral wall 23. Due to the greater height of peripheral wall 23, however, this achieves a height of interior space 11 of housing 10 that enables housing of axle 24.3, which is the longest axle according to FIGS. 1 and 2, and of rotor 4.3, which is the highest rotor according to FIGS. 1 and 2. If base 2 according to FIG. 3 is combined with a higher lid 3.2 or 3.3 according to FIGS. 1 and 2, interior space 11 of housing 10 becomes still higher, so that an axle and a rotor can then be used that are even longer or even higher than the longest or highest corresponding components shown in FIGS. 1 and 2.

FIG. 4 shows, again in longitudinal section, an embodiment of centrifuge 1 having two rotors 4 that are situated on a common base 2. For this purpose, base 2 has two peripheral walls 23 that coincide in the center area of base 2. Concentrically to each of the two peripheral walls 23, a respective axle 24 is set fixedly in base 2. On each axle 24, a rotor 4 is rotatably mounted; here, the two rotors 4 are identical to one another. Here, a separate lid 3 is screwed into each peripheral wall 23, lids 3 here also being identical to one another. In this way, two interior spaces 11 are formed in centrifuge 1, and each interior space 11 is allocated to one of the two rotors 4.

In order to supply the liquid that is to be cleaned, two supply channels 21 are provided in the base; in order to carry off the cleaned liquid, two drainage channels 22 that run in base 2 are used. Advantageously, at the supply side a supply channel is provided that is at first common and that communicates with an associated internal combustion engine, and which then branches into the two supply channels 21 visible in the drawing. Correspondingly, the two drainage channels 22 are advantageously brought together to form a common drainage channel that communicates with the associated internal combustion engine.

Figure 4:
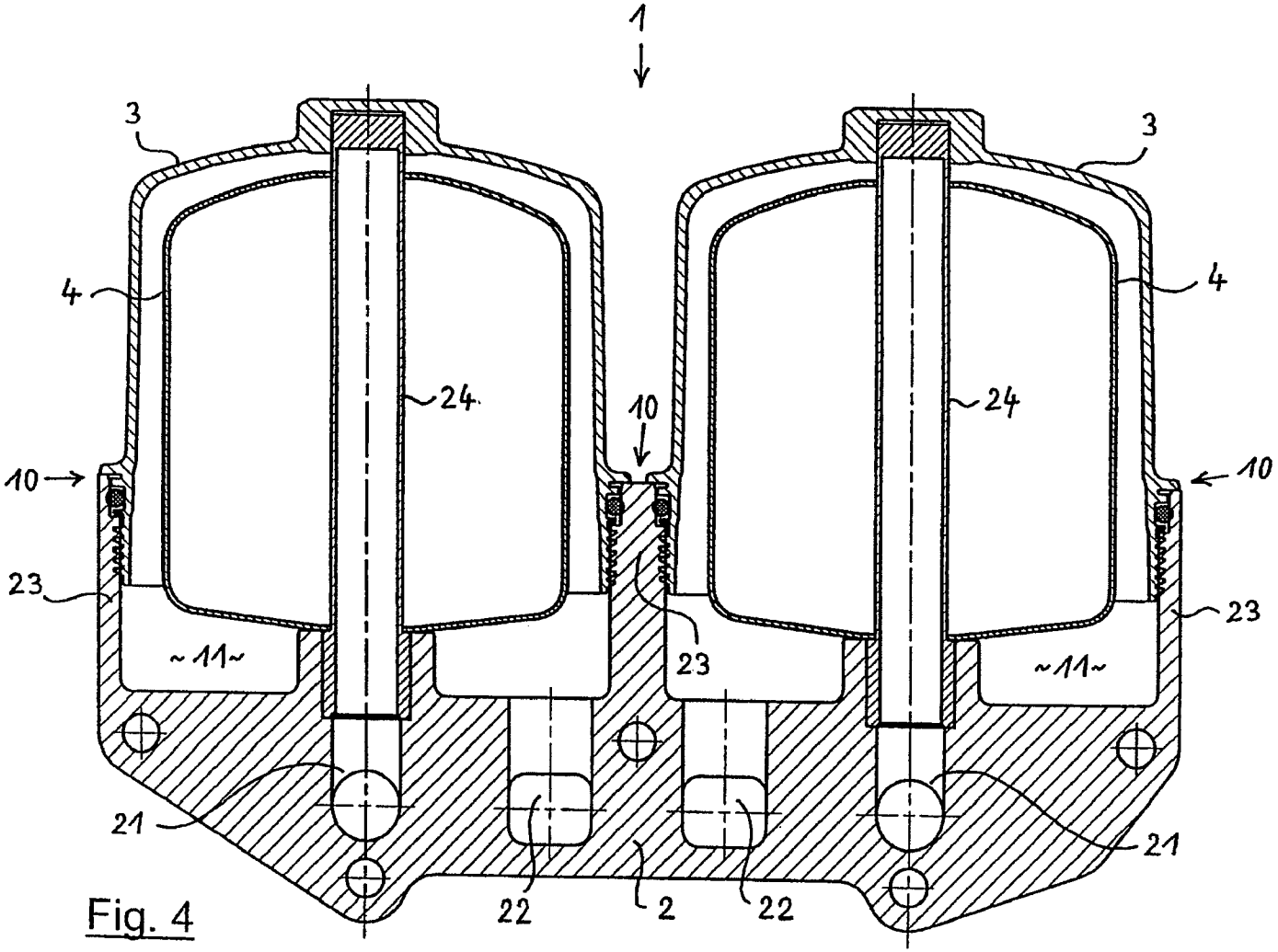
FIG. 4 shows another centrifuge having two rotors in longitudinal section.

Differing from the example shown in FIG. 4, it is of course possible for axles 24 having different lengths, lids 3 having different heights, and rotors 4 having different heights to be connected to base 2 shown in FIG. 4.

Figure 5:
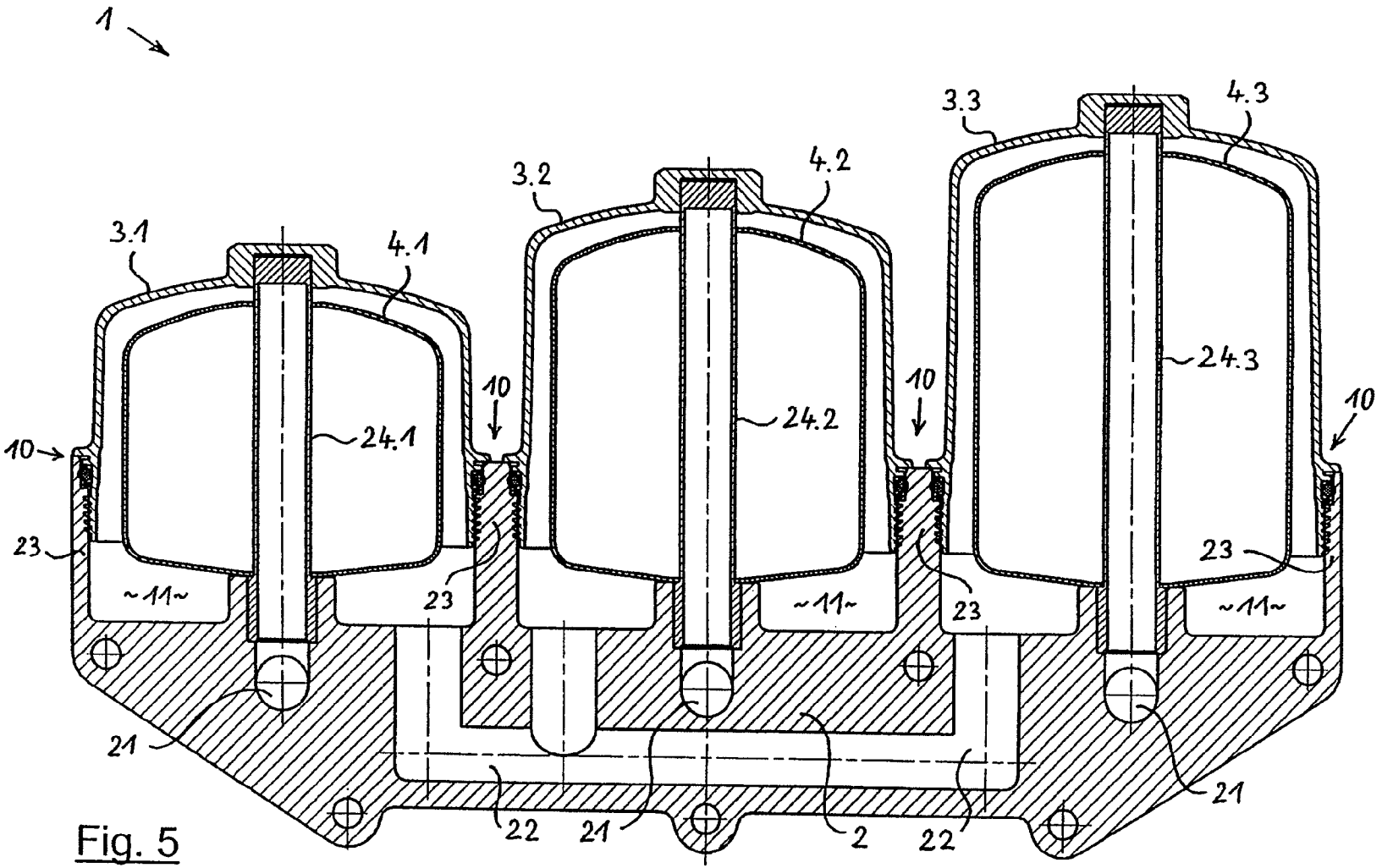
FIG. 5 shows an embodiment of the centrifuge having three rotors, in longitudinal section.

FIG. 5 shows an example of a centrifuge 1 in which three different rotors 4.1, 4.2, and 4.3 are connected to a common base 2. For each rotor 4.1 to 4.3, base 2 has a respective axle 24.1, 24.2, and 24.3 set fixedly therein, these axles having different lengths corresponding to the different heights of rotors 4.1 to 4.3.

Concentric to each axle 24.1 to 24.3, base 2 has on its upper side a respective peripheral wall 23, and these walls partially coincide between adjacent rotors 4.1 and 4.2, or 4.2 and 4.3. From above, a lid 3.1, 3.2, or 3.3, adapted to the axial length and to the height of the respective rotor 4.1 to 4.3, is screwed into each peripheral wall 23, these lids sealing housing 10 upward and bounding an interior space 11 of housing 10 for each rotor 4.1 to 4.3.

In order to supply the liquid that is to be cleaned to the three rotors 4.1 to 4.3, here three supply channels 21 are used, each of which runs perpendicular to the plane of the drawing. Advantageously, here as well a supply channel is provided at the supply side which is at first common and communicates with an associated internal combustion engine and which then branches into the three supply channels 21 visible in the drawing. In order to carry off the cleaned liquid, drainage channels 22 are used, which here can be seen to be brought together to form a common channel that communicates with the associated internal combustion engine.

Of course, base 2 according to FIG. 5 can alternatively also be equipped with two or three axles having equal lengths, two or three lids equal in height, and two or three rotors equal in height.

Figure 6:
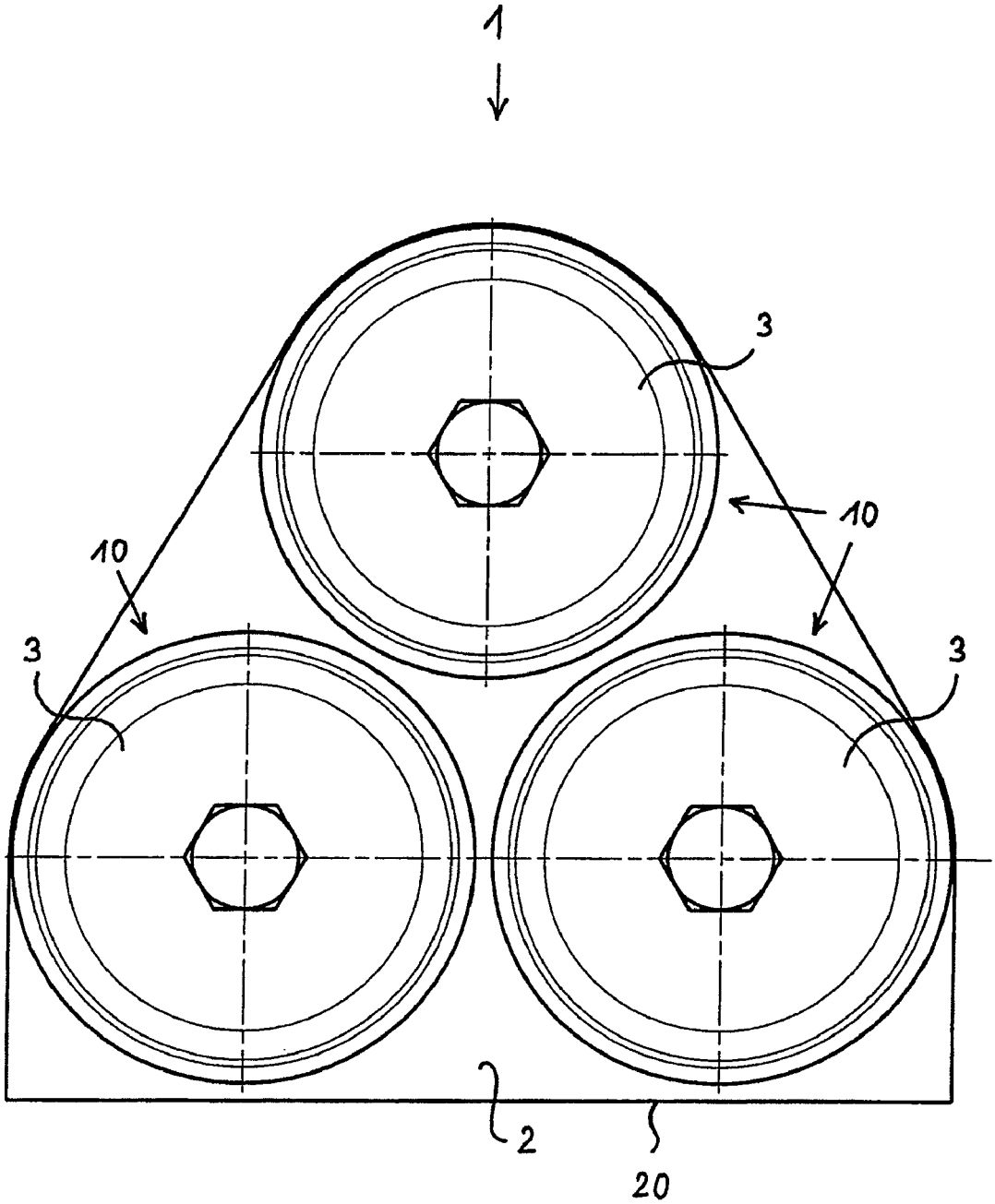
FIG. 6 shows a centrifuge having three rotors, in a top view.

FIG. 6 shows a top view of a centrifuge 1 that has three rotors (not shown) that are situated geometrically relative to one another so as to form an equilateral triangle. The axes of rotation of the individual rotors run parallel to one another and perpendicular to the plane of the drawing. In the top view, the three lids 3 are visible that each form, together with the associated peripheral wall (not shown), housing 10 of centrifuge 1. In FIG. 6, the three lids 3 have equal diameters; the heights of lids 3, oriented perpendicular to the plane of the drawing, can be equal to or different from one another. In this way, three equally high rotors or rotors having two or three different heights can be used in centrifuge 1 according to FIG. 6.

On the side pointing downward in FIG. 6, base 2 has a connecting flange 20 that is used to connect centrifuge 1 to an associated device such as an internal combustion engine. Connecting flange 20 advantageously creates both a mechanical and a flow connection, so that only one work cycle is required for the connection, and external conduits are not used.

Figure 7:
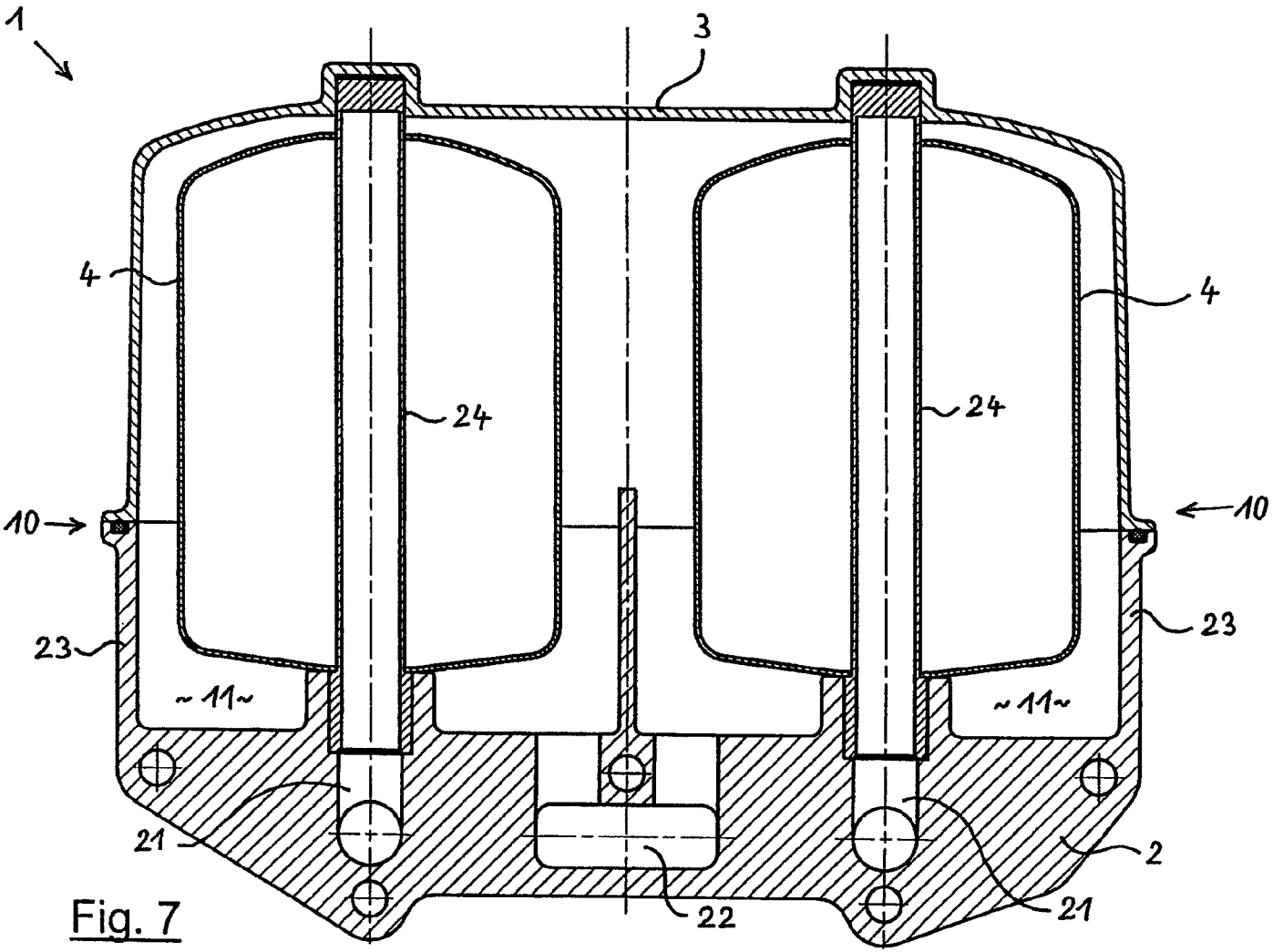
FIG. 7 shows a centrifuge having two rotors, in longitudinal section.

FIG. 7 shows, again in longitudinal section, a centrifuge 1 having two rotors 4, which here are identical to one another. The two rotors 4 are rotatably mounted on a common base 2 by means of a respective axle 24; here, axles 24 are also identical to one another and are attached fixedly in base 2.

Differing from the above-described exemplary embodiments of centrifuges 1 having a plurality of rotors, here only one externally situated individual peripheral wall 23 is provided. Individual peripheral wall 23 works together with a single lid 3 that covers both rotors 4 and that forms, together with base 2, housing 10 having a unified interior space 11.

The supplying of the liquid that is to be cleaned takes place here again via two supply channels 21 that run in base 2; these are advantageously branched off from an at first common channel that corresponds with the associated internal combustion engine. For the carrying off of the cleaned liquid, here a visible common drainage channel 22 is provided in base 2.

Figure 8:
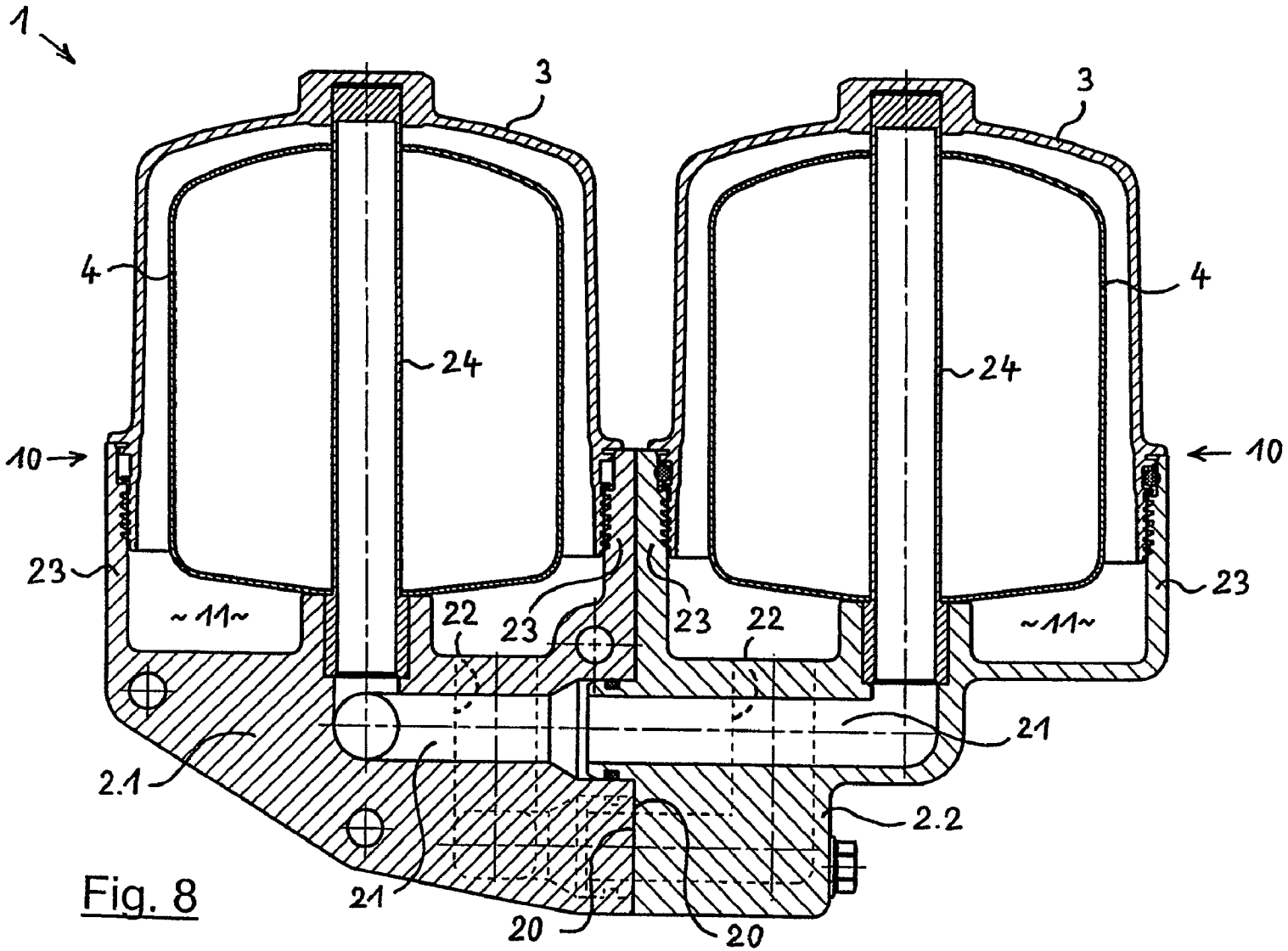
FIG. 8 shows another centrifuge having two rotors, in longitudinal section.

FIG. 8 shows a centrifuge 1 having two rotors 4; this example is characterized in that two different bases 2.1 and 2.2 are used.

First base 2.1 has a first axle 24 and a first rotor 4 mounted rotatably thereon. In addition, first base 2.1 comprises a peripheral wall 23 into which a first screw-on lid 3 is set in sealing fashion from above in order to form housing 10 and to seal interior space 11 outwardly.

Second base 2.2 likewise comprises a peripheral wall 23 into which second lid 3, which is identical to first lid 3, is screwed tightly from above; in interior space 11 there is situated an axle 24, identical to first axle 24, that rotatably bears a second rotor 4 that is identical to first rotor 4.

First base 2.1 forms a master base that is connected mechanically and in terms of flow to a device (not shown) such as an internal combustion engine. At the side pointing to the right in FIG. 8, first base 2.1 has a connecting flange 20, to which second base 2.2 is flange-connected as a slave base by means of its own fitting connecting flange 20, creating both a mechanical and a flow connection. Thus, second base 2.2 is connected to the device, e.g. the internal combustion engine, only indirectly, via first base 2.1.

In each base 2.1 and 2.2 there runs a supply channel 21 for supplying the liquid that is to be cleaned and a drainage channel 22 for carrying off the cleaned liquid; here, channels 22 run behind the plane of the section and are therefore shown only in broken lines. In the area of the flange connection formed by connecting flange 20, the two channels 21 and 22 are connected to one another in terms of flow so as to form a seal, so that a transfer is achieved of liquid to be cleaned from first base 2.1 into second base 2.2, and a transfer is achieved of cleaned liquid from second base 2.2 into first base 2.1. The connection of channels 21 and 22 to the associated device, such as an internal combustion engine, takes place, in a manner not shown in FIG. 8, in the area only of first base 2.1, advantageously via another flange connection.

If, instead of centrifuge 1 according to FIG. 8 having two rotors 4, a centrifuge 1 having only one rotor 4 is required, second base 2.2 can be omitted along with its axle 24, lid 3, and associated rotor 4. The flow connections in connecting flange 20 of first base 2.1 are sealed by suitable stoppers, after which first base 2.1 with its axle 24 and its lid 3 then forms a self-sufficient functioning centrifuge 1 having only one rotor 4.

Figure 9:
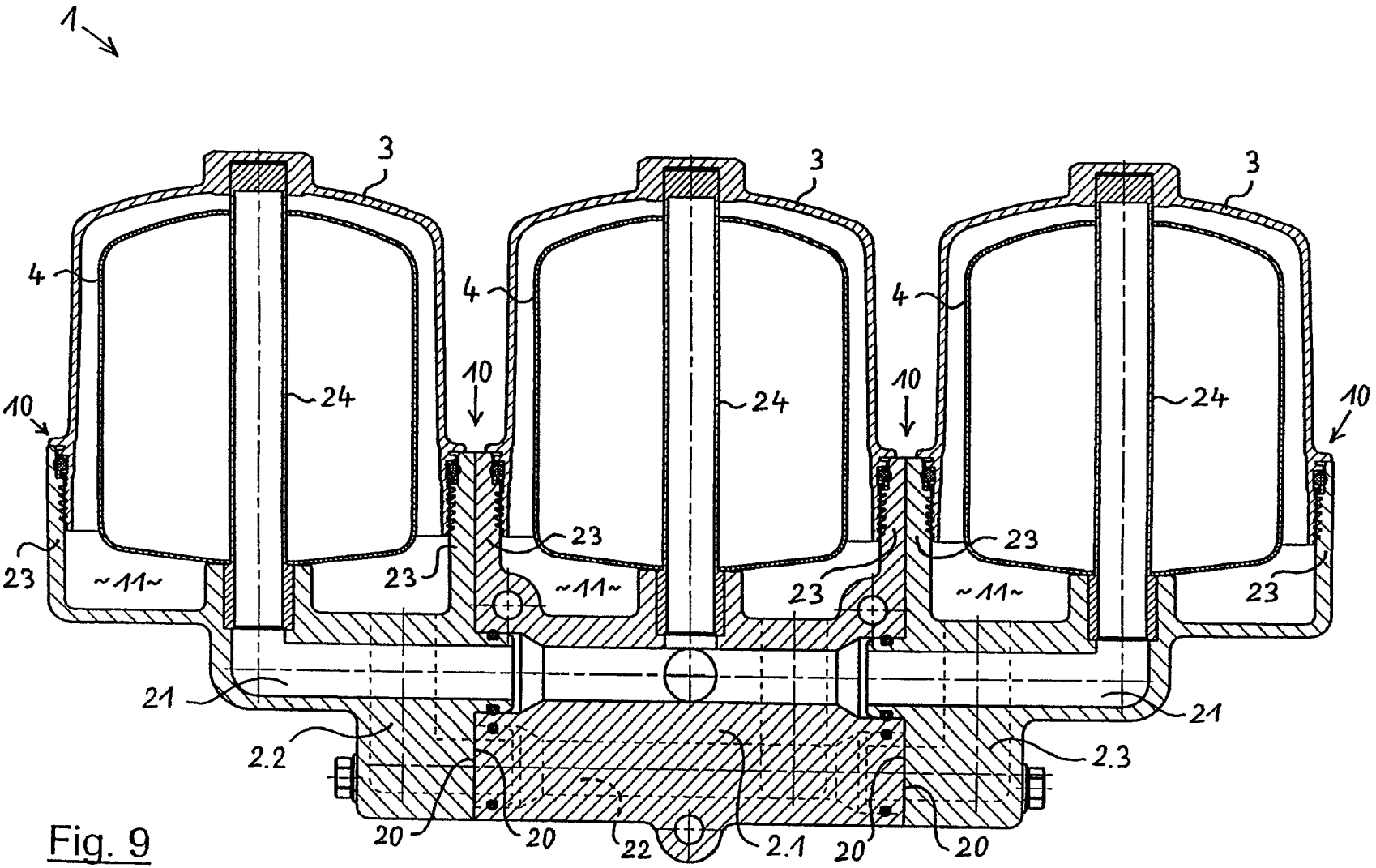
FIG. 9 shows a centrifuge having three rotors, in longitudinal section.

FIG. 9 shows another embodiment of centrifuge 1 in which a first base 2.1 that forms a master base is connected to two second bases 2.2 and 2.3, each of which forms a slave base. Here as well, the connections take place via respective connecting flanges 20. The mechanical and flow connection of centrifuge 1 to an associated device, such as an internal combustion engine, is created in FIG. 9 by master base 2.1, to which slave bases 2.2 and 2.3 are attached as "satellites." As needed, master base 2.1 can also be used alone or with only one slave base 2.2 or 2.3; in this case, at connecting flange or flanges 20 that remain free, channels 21 and 22 for the supplying and carrying off of the liquid are tightly sealed.

As in the example already described in FIG. 8, in centrifuge 1 according to FIG. 9 each base 2.1 to 2.3 has its own peripheral wall 23 into which a respective lid 3 is screwed in sealing fashion from above. In this way, three interior spaces 11 are formed in each of which a respective axle 24 is situated and a rotor 4 is rotatably mounted thereon. In FIG. 9, axles 24, lids 3, and rotors 4 are identical to one another. Here as well, it is of course possible to use two or three axles 24 having different lengths and, correspondingly, two or three rotors 4 having different heights and lids 3 having different heights, bases 2.1 to 2.3 remaining unchanged.

Figure 10:
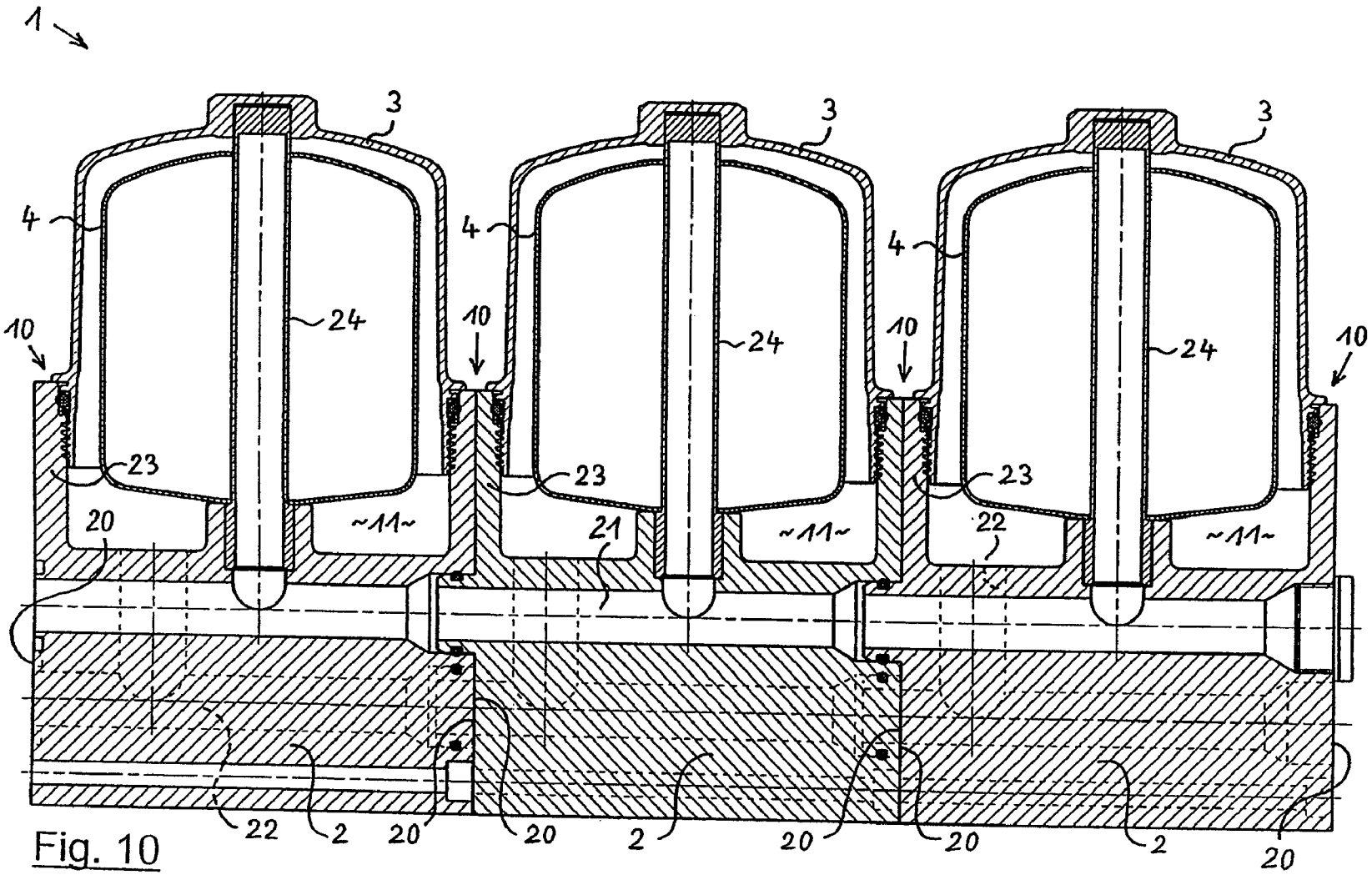
FIG. 10 shows a last centrifuge, also having three rotors, in longitudinal section.

Finally, FIG. 10 shows, as a final exemplary embodiment, a centrifuge 1 characterized in that a plurality (here three) of bases 2 that are identical to one another are connected in a series, the required mechanical and flow connection between each pair of adjacent bases 2 being effected via respective connecting flanges 20. Because bases 2 are identical to one another, a particularly economical manufacture is possible, and bases 2 can be connected in series to one another in the required number. Each base 2 has its own separate peripheral wall 23 into which, again, a lid 3 is screwed from above in sealing fashion in order to form housing 10, which is closed during operation of centrifuge 1. Here, housing 10 comprises three interior spaces 11 that are separated from one another, each interior space 11 having situated in it a respective axle 24 having a rotor 4 mounted rotatably thereon. Here, axle 24, lids 3, and rotors 4 are identical to one another. Here as well, it is of course possible to use axles 24 having different lengths, and lids 3 and rotors 4 having correspondingly different heights.

The connection to an associated device not shown here, such as an internal combustion engine, is created by connecting flange 20 of left base 2, situated at the left in FIG. 10. At the right end of the series of three bases 2, at connecting flange 20 pointing to the right liquid is prevented from flowing out by sealing stoppers that are attached there. As needed, the sealing stoppers on right connecting flange 20 can be removed, and one or more additional bases 2 can then be attached to form a centrifuge 1 having an even higher level of performance.

Supply channels 21 and drainage channels 22 for the liquid that is to be cleaned or that has been cleaned run in the interior of series-connected bases 2, these channels being aligned with and connected to one another; here drainage channels 22 are situated behind the plane of the section and are therefore shown in broken lines. Moreover, additional channels can be provided in bases 2 as needed, as is shown at the bottom in left base 2 by solid lines and in the two bases 2 connected to the right thereof in broken lines, again at the bottom.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. Centrifuges for the lubricant oil of an internal combustion engine, each centrifuge comprising:

a housing comprising a base forming a first housing part and a lid connectable to the base forming a second housing part, and having a rotor situated in the housing, a modular unit assembled from parts of a modular system, the modular system comprising at least one of different bases, different lids, and different rotors that can be assembled in different combinations to form different centrifuges, the modular system comprising various bases that differ with respect to the number of rotors connectable thereto, each base simultaneously bearing two or more rotors.

2. The centrifuges according to claim 1, wherein the modular system comprises a number of different lids corresponding to a different number of rotors connectable to each of the different bases, the lids being uniform in height and each being allocated to one of the rotors.

3. The centrifuges according to claim 1, wherein the modular system comprises a number of different lids corresponding to a different number of rotors connectable to each of the different bases, the lids having different heights and each being allocated to one of the rotors.

4. The centrifuges according to claim 1, wherein the modular system comprises a plurality of different rotors and to each of the various bases there is connectable a lid, common to all the rotors, the lid being adapted to a number and to a height of the different rotors received on the different bases and is adapted to a spatial arrangement of the different rotors.

5. The centrifuges according to claim 1, wherein each base has, for connection to one of an associated device and to an additional base, one or more connecting flanges that provide a simultaneous mechanical and flow connection.

6. The centrifuges according to claim 1, wherein each centrifuge is an open-jet centrifuge, each rotor having at least one jet nozzle.

7. The centrifuges according to claim 1, wherein each rotor is made at least predominantly of plastic.

8. Centrifuges for the lubricant oil of an internal combustion engine, each centrifuge comprising:

a housing comprising a base forming a first housing part and a lid connectable to the base forming a second housing part, and having a rotor situated in the housing, a modular unit assembled from parts of a modular system, the modular system comprising a common base, different lids having different heights, and different rotors having different heights that can be assembled in different combinations to form different centrifuges.

9. The centrifuges according to claim 8, wherein the base has, for connection to one of an associated device and to an additional base, one or more connecting flanges that provide a simultaneous mechanical and flow connection.

10. The centrifuges according to claim 8, wherein each centrifuge is an open-jet centrifuge, each rotor having at least one jet nozzle.

11. The centrifuges according to claim 8, wherein each rotor is made at least predominantly of plastic.

12. Centrifuges for the lubricant oil of an internal combustion engine, each centrifuge comprising:

a housing comprising a base forming a first housing part and a lid connectable to the base forming a second housing part, and having a rotor situated in the housing, a modular unit assembled from parts of a modular system, the modular system comprising at least one of different bases, different lids, and different rotors that can be assembled in different combinations to form different centrifuges, the modular system comprising various bases, namely a first base that is connectable as a master base to an associated device, and at least one second base that is connectable to the first base as a slave base.

13. The centrifuges according to claim 12, wherein each base has, for connection to one of an associated device and to an additional base, one or more connecting flanges that provide a simultaneous mechanical and flow connection.

14. The centrifuges according to claim 12, wherein each centrifuge is an open-jet centrifuge, each rotor having at least one jet nozzle.

15. The centrifuges according to claim 12, wherein each rotor is made at least predominantly of plastic.

16. Centrifuges for the lubricant oil of an internal combustion engine, each centrifuge comprising:

a housing comprising a base forming a first housing part and a lid connectable to the base forming a second housing part, and having a rotor situated in the housing, a modular unit assembled from parts of a modular system, the modular system comprising at least one of different bases, different lids, and different rotors that can be assembled in different combinations to form different centrifuges, the modular system comprising a base connectable to an associated device and connectable to additional, identical bases in a series-connected fashion.

17. The centrifuges according to claim 16, wherein each base has, for connection to one of an associated device and to an additional base, one or more connecting flanges that provide a simultaneous mechanical and flow connection.

18. The centrifuges according to claim 16, wherein each centrifuge is an open-jet centrifuge, each rotor having at least one jet nozzle.

19. The centrifuges according to claim 16, wherein each rotor is made at least predominantly of plastic.

* * * * *